United States Patent [19]

Riley

[11] Patent Number: 4,862,537

[45] Date of Patent: Sep. 5, 1989

[54] PORTABLE BED STIFFENER

[76] Inventor: Martin O. Riley, 1330 Hillcrest Ave., Pasadena, Calif. 91106

[21] Appl. No.: 303,483

[22] Filed: Jan. 27, 1989

[51] Int. Cl.[4] ..... A47C 21/06

[52] U.S. Cl. ..... 5/446; 5/508

[58] Field of Search ..... 5/462, 464, 508, 446, 5/447

[56] References Cited

U.S. PATENT DOCUMENTS

| | | | |
|---|---|---|---|
| 2,847,685 | 8/1958 | Freedlander | 5/446 |
| 2,885,695 | 5/1959 | Feezel et al. | 5/446 |
| 3,125,768 | 3/1964 | Rickert | 5/446 |
| 3,245,092 | 4/1966 | Kreuz | 5/446 X |
| 4,365,371 | 12/1982 | Boussarogne | 5/462 |
| 4,649,583 | 3/1987 | Krueger, Sr. | 5/446 X |

*Primary Examiner*—Gary L. Smith
*Assistant Examiner*—Michael F. Trettel
*Attorney, Agent, or Firm*—Freilich, Hornbaker, Rosen & Fernandez

[57] ABSTRACT

A bed stiffener is provided which is of simple and rugged construction and which can be stowed in a relatively compact configuration. The bed stiffener includes three boards that are all of about the same width, including a middle board whose opposite sides are pivotally connected to end boards. In a stowed configuration, a first of the end boards lies facewise against the rear face of the middle board, while the second end board lies facewise against the first end board. In one bed stiffener, the first and middle boards are connected at a pivot axis that lies about even with the rear face of the middle board, while the second and middle boards are connected at a second pivot axis that lies below the lower face of the middle board by a distance about equal to half the thickness of the boards.

6 Claims, 2 Drawing Sheets

FIG. 1
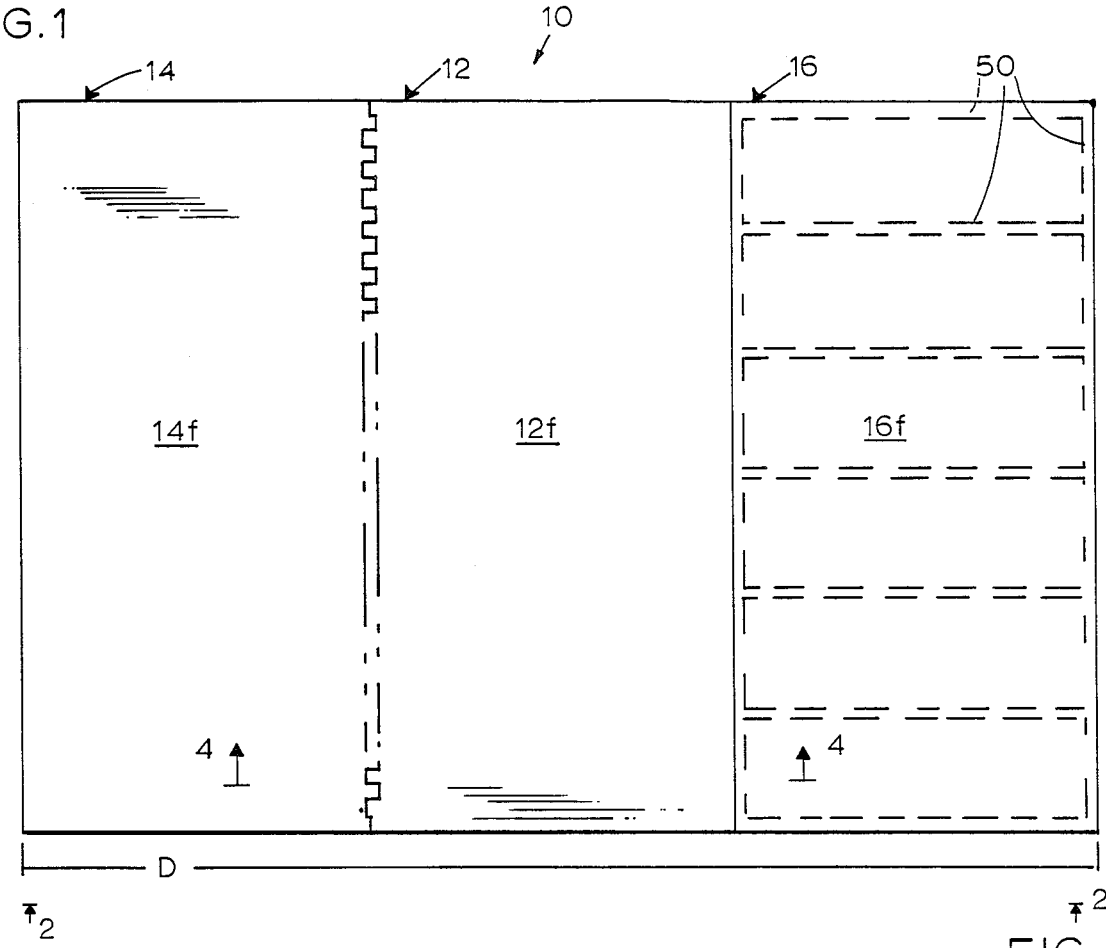
FIG. 2
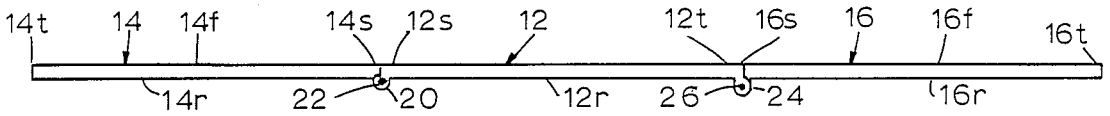
FIG. 3
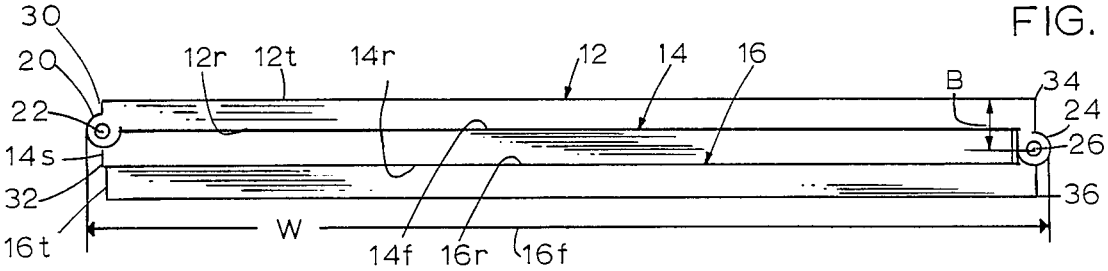
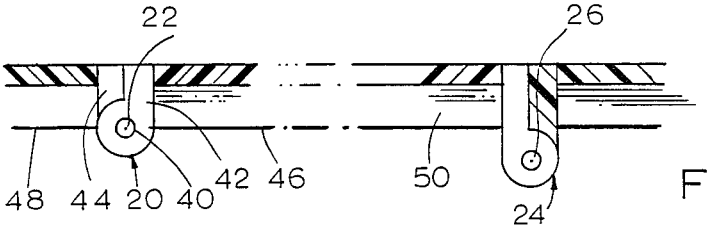
FIG. 4

PORTABLE BED STIFFENER

BACKGROUND OF THE INVENTION

Bed stiffeners are often used under a mattress to provide a stiffer sleeping surface to avoid back problems. A stiffener of a size such as 3 feet by 2 feet is often sufficient. Such a board is unwieldy to carry, and there have been attempts to provide boards that can be folded or slid to a compact stowed state for transport and then to a deployed state for use. A bed stiffener assembly which, in its stowed configuration, had a width of about 1 foot and length of about 2 feet in the stowed configuration would be reasonably easy to carry under one arm. This suggests a stiffener with three sections or boards that can lie facewise against one another in the stowed configuration.

One approach, described in U.S. Pat. No. 2,885,695 by Feezel suggests the use of a wide middle board and narrower end boards that may be half as wide as the middle board and which can each fold against the rear face of the middle board. This has the disadvantage that, even though three boards are used, the stowed apparatus has a width only one half that of the deployed apparatus, instead of about one third as much. It would be possible to use three hinged boards, with one end board pivoting against the rear face of the middle board and the other end pivoting against the front face of the middle board, but special precautions would have to be taken to prevent upward pivoting of the second end board in the deployed position of the apparatus. A bed stiffener of relatively simple construction, which could be folded into a compact configuration for holding under a person's arm, or storage on a hotel maid's cart, and which could be simply and rapidly moved to a deployed configuration wherein it could stiffen a mattress, would be of considerable value.

SUMMARY OF THE INVENTION

In accordance with one embodiment of the present invention, a bed stiffener is provided, which is of sturdy construction, which can be easily moved between stowed and deployed configurations, and which is of relatively small size in the stowed configuration. The bed stiffener includes a middle board and first and second end boards that are pivotally connected to opposite sides of the middle board. A first hinge joint connects the middle and first end boards, and allows the first end board to move to a stowed configuration at which it lies substantially facewise against the rear face of the middle board. A second hinge joint connects the middle and second end boards, and allows the second end board to be moved to a stowed configuration at which it lies substantially facewise against the stowed first end board. Thus, in the stowed configuration the first end board is sandwiched between the middle board and second end board. The stowed apparatus can be moved to the deployed position by merely pivoting the second end board and then the first end board to lie coplanar with the middle board, the sides of the boards then abutting to prevent pivoting of the boards past a substantially coplanar position.

The novel features of the invention are set forth with particularity in the appended claims. The invention will be best understood from the following description when read in conjunction with the accompanying drawings.

BRIEF DESCRIPTION OF THE DRAWINGS

FIG. 1 is a plan view of a bed stiffener constructed in accordance with one embodiment of the present invention.

FIG. 2 is an end view taken on the line 2—2 of FIG. 1.

FIG. 3 is an end view of the apparatus of FIG. 2, shown in a stowed configuration.

FIG. 4 is a sectional view taken on the line 4—4 of FIG. 1.

DESCRIPTION OF THE PREFERRED EMBODIMENTS

Figure 5:
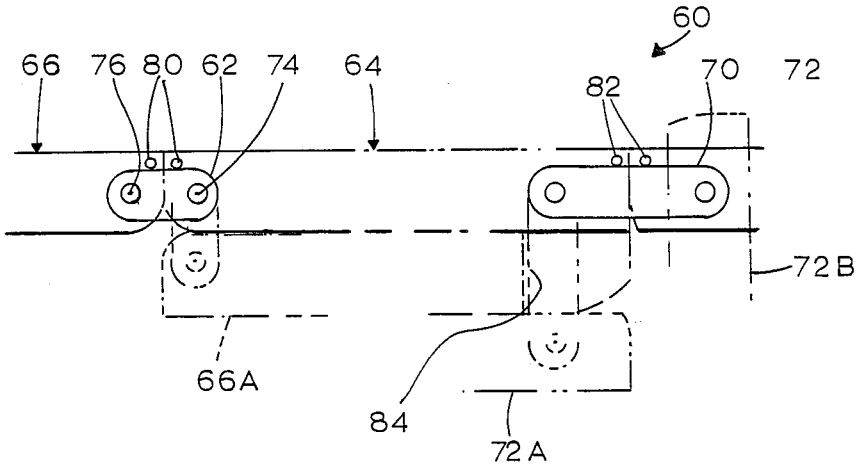
FIG. 5 is a partial end view of a bed stiffener constructed in accordance with another embodiment of the invention.

FIG. 1 illustrates a bed stiffener 10 which is formed by three boards, including a middle board 12 and first and second end boards 14, 16. As also shown in FIG. 2, each of the boards has a front face **12*f*–16*f* and a rear face 12*r*–16*r*. The middle board has opposite sides 12*s*, 12*t*, while each of the end boards has opposite sides 14*s*, 14*t* and 16*s*, 16*t*. A first hinge joint 20 formed at adjacent sides 12*s*, 14*s* of the middle board 12 and first end board 14 pivotally joins them so they can pivot about an axis 22. Similarly, a second hinge joint 24 formed at adjacent sides 12*t*, 16*s* of the middle and second end boards 12, 16 joins them in pivoting about an axis 26**.

The bed stiffener can be moved from the deployed state of FIG. 2 to the stowed state of FIG. 3 by first pivoting the first end board 14 to the position shown in FIG. 3, where the front face **14*f* of the first end board lies substantially facewise against the rear face 12*r* of the middle board 12. Then, the second end board 16 is pivoted until its rear face 16*r* lies substantially facewise against the rear face of the first end board. In this configuration, shown in FIG. 3, the width W of the stowed bed stiffener is about one third the width of the deployed bed stiffener. Where the bed stiffener has a deployed longest dimension D (FIG. 1**) of about 3 feet, it has a stowed width W of about 1 foot, which enables the stiffener to be conveniently carried under a person's arm or on a hotel maid's cart.

The first pivot axis 22 (FIG. 3) lies at a height (assuming the front face **14*f* of the middle board is horizontal and facing upwardly) that is about the same as the rear face 12*r* of the middle board; the axis 22 lies at the extreme sides of the middle and first end boards. This arrangement results in the first end board pivoting to a position substantially facewise against the rear face of the middle board in the stowed configuration. In the deployed configuration, locations 30, 32 at the adjacent sides of the middle and first end boards, near their front surfaces, can abut; this assures that in the deployed configuration the front faces 12*f*, 14*f* of the middle and first end boards are substantially coplanar. The distance between the pivot axis 22 and the locations 30, 32 are about equal to the thickness of the boards, to enable resistance to pivoting past the coplanar position in the deployed configuration. The second pivot axis 26 is located a distance B below the rear face 12*r* of the middle board, and a corresponding distance from the front face 16*f* of the second end board. This results in the second board moving to a stowed position where it lies substantially facewise against the stowed first end board. There is a substantial distance between the pivot axis 26 and locations 34, 36 at the adjacent edges of the middle and second end boards at their front faces, to resist pivoting of the deployed second end board past a position substantially coplanar with the middle board. It is preferable that the second end board 16** lie closest to the head of the bed, because most of the weight of a sleeper is between the middle and head end of the bed, where the bed stiffener can best resist pivoting past a configuration wherein the front faces of the boards are substantially coplanar.

FIG. 4 illustrates some details of the construction of the bed stiffener. The hinge joint 20 includes intefitting hinge sections 42, 44 with aligned holes held together by a hinge pin 40 extending through the holes. Each board 12–16 can be molded of plastic with integral hinge sections such as 42, 44 that form adjacent side portions of the middle and first end boards. Each board also includes a body portion 46, 48 integral with corresponding sections 42, 44. The second hinge joint 24 is similarly constructed, although its pivot axis lies further below its top. The body has thick bracing portons 50 (shown in hidden lines for board 16 in FIG. 1) and is thinner elsewhere. Of course, separate bodies and separate metal hinges attached to them can be used instead.

FIG. 5 illustrates another bed stiffener 60 which uses a first set of links to pivotally connect adjacent sides of a middle board 64 and first end board 66 and another set of links 70 to connect adjacent sides of the middle board 64 to a second end board 72. Each first link 62 is pivotally connected about two axes 74, 76 lying on the two boards, which permits the first end board to pivot from the deployed position 66 to a stowed position 66A. The second link 70 is longer to permit the second board 72 to move from a deployed position 72 to a stowed position 72A wherein it lies spaced from the middle board by the thickness of the first end board 66A. In moving the second end board to the stowed position, it is first pivoted to an intermediate position 72B, so that it clears the stowed first end board when the second end board is moved to its stowed position. A first pair of stop pins 80 abut the first link 62 to prevent the first end board from rising above its deployed position, while a second set of stop pins 82 prevents the second end board from rising its deployed position. It may be noted that where one of the links 70 lies along the middle of the boards, a slot 84 is formed in the outer edge of the first end board 66 to receive the link.

Applicant has constructed a bed stiffener of the type shown in FIG. 1, of a dimension D of 36 inches, and a perpendicular dimension of 24 inches. The middle and second end boards each have a width of 12 inches, while the first end board 14 has a smaller width of about 11 and 11/16ths inch to prevent interference with the second hinge in the stowed position. Each of the boards has a thickness of one half inch. The stowed bed stiffener of FIG. 3 can be securely held together by a latch (not shown) that connects a location near the edge **16*t* of the second end board to a location near an adjacent edge 14*s*** of the first end board.

Thus, the invention provides a bed stiffener formed by three pivotally connected boards, which is of simple and rugged construction and is easily moved between a deployed position for use and a stowed position for easily carrying under the arm or on a hotel maid's cart. The bed stiffener includes a middle board, a first end board which can pivot to a stowed position wherein it lies facewise against the rear face of the middle board, and a second end board which can pivot to a stowed position wherein it lies facewise against a face of the first end board opposite the middle board.

Although particular emodiments of the invention have been described and illustrated herein, it is recognized that modifications and variations may readily occur to those skilled in the art and consequently it is intended to cover such modifications and equivalents.

What is claimed is:

1. A bed stiffener comprising:

three boards, including a middle board and first and second end boards, said boards each having front and rear faces and opposite sides, said three boards forming first and second hinge joints each pivotally connecting one of said sides of said middle board to one side of one of said end boards;

said first hinge joint pivotally supporting said first end board in pivoting between a deployed position wherein said front faces of said middle and first boards face in the same direction and a stowed position wherein said rear face of said first end board lies substantially facewise against said rear face of said middle board, and said second hinge joint pivotally supporting said second end board in pivoting between a deployed position wherein said front faces of said middle and second boards face in the same direction and a stowed position wherein said rear face of said second board lies substantially facewise against said front face of said stowed first board.

2. The bed stiffener described in claim 1 wherein:

said second hinge joint has a pivot axis lying below said rear face of said middle board, when said front upper face of said middle board lies horizontal and faces upwardly, by a distance about equal to half the thickness of said middle board.

3. The bed stiffener described in claim 1 wherein:

said middle board and second board have about the same widths as measured between their opposite sides at their front faces, while said first end board has a smaller width than said middle and second boards;

said second hinge joint has a pivot axis that, in said stowed position of said end boards lies about halfway between the rear face of the middle board, and the front face of the second end board, and lies adjacent to a side of the stowed first end board.

4. A bed stiffener comprising:

a middle board having opposite sides and front and rear faces;

first and second end boards, each having opposite sides and front and rear faces, each end board movable between a deployed position wherein its front face lies substantially coplanar with the front face of said middle board and each end board and said middle board have adjacent sides, and a stowed position wherein each end board lies behind the rear face of the middle board;

said boards forming a first hinge joint pivotally connecting adjacent sides of said first end board and said middle board, said first hinge joint having a pivot axis lying at about the rear face of the middle board and the rear face of the first end board;

a second hinge joint pivotally connecting adjacent sides of said second end board and said middle board, said second hinge joint having a pivot axis lying about halfway between the rear face of said middle board and said second end board in the stowed position of said end board.

5. The bed stiffener described in claim 4 wherein: said first end board is shorter than said middle board, and said second hinge joint lies adjacent to a side of said first end board in the stowed position of the first board.

6. The bed stiffener described in claim 4 wherein: said boards each have a body portion and a hinge section molded integrally therewith, the hinge sections of boards with adjacent sides in the deployed position interfitting and forming aligned holes, and including a hinge pin extending through the aligned holes.

* * * * *